US005934454A

United States Patent [19]

Burleson et al.

[11] Patent Number: 5,934,454

[45] Date of Patent: Aug. 10, 1999

[54] THIN KEYBOARD HAVING MULTIPLE HINGE MEMBERS PER KEYSWITCH

[75] Inventors: Winslow Scott Burleson, Palo Alto; Christopher Eisbach, Mountain View, both of Calif.

[73] Assignee: International Business Machines Corporation, Armonk, N.Y.

[21] Appl. No.: 08/949,025

[22] Filed: Oct. 10, 1997

[51] Int. Cl.[6] ..... H01H 13/70

[52] U.S. Cl. ..... 200/343; 200/5 A; 200/517

[58] Field of Search ..... 200/5 A, 512–517, 200/341–345

[56] References Cited

U.S. PATENT DOCUMENTS

| | | | |
|---|---|---|---|
| 4,032,729 | 6/1977 | Koistinen | 200/5 A |
| 4,160,886 | 7/1979 | Wright et al. | 200/5 A |
| 4,315,114 | 2/1982 | Monti, Jr. | 200/5 A |
| 4,480,162 | 10/1984 | Greenwood | 200/343 X |
| 4,638,151 | 1/1987 | Suwa | 235/145 R |
| 5,003,140 | 3/1991 | Abell, Jr. et al. | 200/344 |
| 5,198,991 | 3/1993 | Pollitt | 364/708 |
| 5,278,372 | 1/1994 | Takagi et al. | 200/344 |
| 5,280,147 | 1/1994 | Mochizuki et al. | 200/344 |
| 5,329,084 | 7/1994 | Watanabe et al. | 200/344 |
| 5,382,762 | 1/1995 | Mochizuki | 200/5 A |
| 5,457,453 | 10/1995 | Chiu et al. | 341/22 |
| 5,874,697 | 2/1999 | Selker et al. | 200/5 A |

*Primary Examiner*—J. R. Scott

*Attorney, Agent, or Firm*—James C. Pintner; Romualdas Strimaitis

[57] ABSTRACT

A keyboard apparatus is provided for small and lightweight computers and the like. Keyswitches and a keyboard assembly comprise a sheet member having a plurality of key faces fixed thereon in a conventional keyboard arrangement. A plurality of cutouts are provided in the sheet member, partially surrounding each key face. Two living hinge members are provided in the sheet member, preferably at opposite sides of the cutout. Each living hinge member includes a base section, an intermediate section, and a key face section. The former two and the latter two sections each interface at a living hinge. Depressing the key face causes the key face sections of each of the hinge members to pivot about the living hinges to operate a corresponding set of electrical contacts, indicating operation of the key. The multiple hinge members provide stability to the downward motion of the key face, providing goood functionality and tactile feel. In a preferred embodiment, a first one of the hinge members includes a relatively wide key face section with a notch in the middle. The notch accommodates a relatively narrow key fact section of the second hinge member, so that the second hinge member nests within the first hinge member when the key face is depressed.

12 Claims, 6 Drawing Sheets

THIN KEYBOARD HAVING MULTIPLE HINGE MEMBERS PER KEYSWITCH

FIELD OF THE INVENTION

The invention generally relates to the field of computer user interface technology. More specifically, the invention relates to keyboards. The invention has particular applicability to portable computers.

BACKGROUND OF THE INVENTION

General Background Art

Keyboards are essential input devices for many applications, including for personal computers. As described above, such personal computers are often designed to be transportable and have been occupying less cubic volume over time. An example of such a portable personal computer is described in coassigned U.S. Pat. No. 5,198,991, incorporated by reference herein for the purpose of describing the computer per se and the connections between the computer and a folding keyboard, and such description will not be repeated here.

The miniaturization of data processing equipment, for portability and ease of use, is becoming increasingly important. However, there are some factors which place practical limits on the miniaturization which could theoretically be achieved.

The limiting factor for reducing the size of portable data processing equipment is generally the keyboard. A keyboard requires sufficient size, in terms of horizontal dimensions, for the keys. Keys are constrained to at least a certain minimum size, because they must have a size and spacing commensurate with the size of an average operator's fingers and hands.

Keyboards also requires mechanics, for converting keystrokes to electrical signals representative of operation of the keys. Some minimum thickness must be provided for these components. Also, the keys preferably have enough vertical displacement to give the user a good tactile feel.

Some conventional keyboards, particularly full-size desktop computer keyboards, have used mechanics such as "chimneys," sleeves that slide up and down. Such structures provide the advantage that all parts of the key are stable pressing down. That is, the key is constrained to a single, vertical transnational degree of freedom, so the key presses down in a vertical fashion.

Another conventional structure that of using scissors that use two members that pivot at the center and are attached at one end and the other end of them slides a lot, one can achieve pressing anywhere on the key (pressing the key vertically up and down.

Prior U.S. Pat. No. 5,280,147, Mochizuki et al., assigned to Brother Kogyo Kabushiki Kaisha, reduces the thickness of the keyboard by the use of scissors-like pivotally connected support levers with pivot connections at one end of each lever to respectively the base and the key, and sliding pivot connections at the opposite ends. A conventional nonlinear rubber spring or "dome" is used to transmit the keystroke to electrical contacts to make the connection, indicating operation of the key.

These mechanisms are fine for desktop keyboards, when there is vertical space to be had. However, they are less suitable for portable computers. Such computers are designed for small size and light weight. In particular, reducing the thickness, and producing a "thin" keyboard, has been an important design objective. For such thin keyboards where there is little vertical space, other mechanisms have been used.

A typical portable data processor, or "portable personal computer" or "personal digital assistant", has a keyboard panel and a display panel, and the data processor is incorporated within one of the panels. The two panels are then folded together so that the bottom of the keyboard panel and the back of the display panel from an outer case for the folded unit. By reducing the thickness of the keyboard, the thickness of the overall folded unit may also be reduced, making the folded portable data processing unit easier to handle and to carry.

Prior U.S. Pat. No. 5,457,453, Chiu et al., unassigned, illustrates a keyboard having reduced thickness when folded, by moving otherwise conventional plunger keys to depressed positions when folding is to occur.

U.S. patent application Ser. No. 08/801,833

Co-pending, co-assigned U.S. patent application Ser. No. 08/801,833, now U.S. Pat. No. 5,874,697 Selker et al., "Thin Keyboard," describes keyswitches and a thin keyboard assembly. This co-pending patent application is hereby incorporated by reference. As background information for the present patent application, the apparatus described in the '833 application will be described here, in some detail. FIGS. 1, 2, 6, 7, and 8 of the '833 application are reproduced as FIGS. 1, 2, 3, 4, and 5, respectively, of the present patent application.

The assembly comprises a sheet member having a plurality of key faces fixed thereon in a conventional keyboard arrangement. A plurality of cutouts are made in the sheet member partially surrounding each key face. The cutouts define hinge members, which are cut away from the rest of the sheet member, typically on three of four sides, so that the hinge members have some freedom to flex, relative to the remainder of the sheet member. Key faces will be affixed to, or molded onto, the hinge members so that, when a user depresses the key face with a fingertip, the hinge member is subjected to a flexing force.

A plurality of living hinges (that is, hinges made from the same material making up the hinge members themselves, the hinges having greater resiliency and flexibility than the remainder of the hinge member, so that externally applied stress causes flexing of the living hinge, rather than flexing of the remainder of the hinge member) are made in the hinge members at one side of each key face.

Accordingly, the key face may be depressed, causing the key face to pivot about the living hinges to operate a corresponding set of electrical contacts, indicating operation of the key. A conventional rubber spring may transmit the pivot motion of the key face to the electrical contacts.

Two embodiments are given, one comprising a planar sheet with a single living hinge at one side of each key, whereby depression of the key face causes the key face to pivot downward about the living hinge. The other embodiment comprises two living hinges at one side of each key, allowing the key face to remain level while the pivoting about both hinges. Such a key requires advantageously low force to be operated.

Referring to FIG. 1, a keyboard assembly 10 is comprised of a plurality of key faces 11 arranged in rows according to the conventional "QWERTY" format. A face plate 12 covers the spaces of the keyboard assembly between the key faces. Electrical lines 14 and 15 extend from the keyboard assembly for connection to a data processor, as will be described. A base plate of the keyboard and the face plate 12 are connected together about the periphery of the keyboard as shown by edges 50 and 51.

The First Embodiment of the '833 Application

FIG. 2 illustrates, in greatly expanded scale, the first of the embodiments of the '833 application. A planar sheet 20 extends under the face plate 12 of the keyboard assembly of FIG. 1. The planar sheet preferably comprises a plastic material having both aspects of flexibility and of stiffness. The preferred material is Mylar.

One of the key faces 11 is affixed to, or molded onto, the planar sheet 20. Thus, the key faces 11 are supported by the planar sheet 20. A cutout 22, forming a hinge member, extends partially around the key face 11, on three sides thereof. Each end, or terminus, of the cutout 22 may be squared off, or, preferably, comprises a rounded terminus 23 and terminus 24.

The termini of the ends of the cutout are connected by a living hinge 26, forming a center section 28 of the planar sheet.

Thus, depression of the key face 11 causes the key face and center section 28 to pivot downward, rotating about the living hinge 26. The living hinge is a natural consequence of the positioning of the termini 23 and 24, but alternatively may be etched or cut into the planar sheet 20.

Unfortunately, the pressure required at one end of the key (at the top of the key) was much lower than at the bottom of the key where the hinge was made. The difference between 200 grams and 50 grams was measured. In fact, if one pressed very close to the hinge, one would imagine that there would be no motion at the hinge if one presses on the hinge itself.

The Second Embodiment of the '833 Application

FIGS. 3, 4 and 5 illustrate, in greatly expanded scale, a second embodiment of the invention described in the '833 application. This alternative sheet member and keyswitch arrangement required a substantially reduced actuation force. The actuation force for the keyswitch arrangement of FIG. 2 is approximately 80 grams, whereas the arrangement of FIGS. 3–5 is approximately 60 grams.

Referring to FIGS. 3–5, the sheet member 70 extends under the spacer 46 of the keyboard assembly of FIG. 1. The planar sheet 70 is the same material as planar sheet 20, preferably comprising a plastic material having both aspects of flexibility and of stiffness, such as Mylar. One of the key faces 11 is affixed to and supported by the planar sheet 70.

A cutout 72 extends partially around the key face 11, on three sides thereof, and forms a first living hinge 73. The cutout 72 continues inward, towards the center of the key 11 to form a terminus 75 and a terminus 76. The termini of the ends of the cutout are connected by a second living hinge 77, under the key face 11.

The cutout 72 thereby forms a center section 28 of the planar sheet, forming a hinge member. The hinge member includes a key face section, a center or intermediate section, and a base section, and two living hinges 73 and 77 at which the sections interface.

Thus, depression of the key face 11 causes the key face and center section 78 to stay level and pivot about the living hinges 73 and 77, moving forward slightly, to move from the quiescent, unactuated position of FIG. 4 to the depressed, actuated position of FIG. 5.

The living hinges 73 and 77 are a natural consequence of the positioning of the cutout 72 and the termini 75 and 76, but alternatively may be etched or cut into the planar sheet 70.

The mechanism of FIGS. 3–5 preferably is implemented as a mylar double hinge. By having the hinge off a piece of mylar be a line that bends, then a segment that does not bend, and another line that bends, followed by a piece of plastic on top to hold the key, the back of the key requires the same force to press down, even though it is close to the hinge.

It has been found that the mechanism of FIGS. 3–5 advantageously improves the evenness of required keystroke pressure. However, there is room for further improvements in key apparatus technology, so as to provide more even pressure requirements, while also being thin and lightweight enough for use with portable computers.

SUMMARY OF THE INVENTION

It is a further object of the invention to provide a key structure that is responsive to a substantially constant user fingertip pressure, regardless of which part of the key upon which the fingertip pressure is concentrated.

To achieve this and other objects, there is provided, in accordance with the invention, a keyswitch apparatus for producing a signal representative of a symbol, responsive to manipulation, by a user, of a keyboard key corresponding with the symbol.

The keyswitch apparatus according to the invention comprises the following components:

Electrical contact members are provided, having normally separated contacts, which make electrical contact when the keyswitch assembly is vertically compressed.

A thin sheet of resilient material, preferably Mylar, is provided. A keyswitch region of the sheet of material has a cutout which forms first and second hinge members. Each of the hinge members is preferably cut out from the sheet of material, to have one side connected to the remainder of the sheet, and the other sides detached from the sheet.

The base sections of the first and second hinge members are connected to different portions of the remainder of the sheet, the different portions preferably being on opposite sides of the keyswitch region.

Each of the hinge members has three sections, a base section including the side still connected to the remainder of a sheet, an intermediate section adjacent to the base section, and a key face section adjacent to the intermediate section and farthest from the connection to the remainder of the sheet.

Each of the two hinge members has a first axis, forming a boundary between the base and intermediate sections, and a second axis forming a boundary between the intermediate and key face sections. The base section and the intermediate section interface at a first living hinge along the first axis. The key section interfaces with the intermediate section at a second living hinge along the second axis. The sections of the hinge members are pivotable about the first and second axes.

The key face section of the first hinge member supports a key face affixed thereon. The key face section of the second hinge member abuts the bottom of the key face, but is not affixed to the key face.

The hinge members have a quiescent position, in which the hinges are bent, so as to position the key face sections in a different plane from that of the sheet of material. When the key face is pressed, both of the hinge members pivot about their first and second axes. This pivoting causes the hinge members to move downward, flattening out. This flattening out brings about an electrical contact between the electrical contact members. When the user releases the key face, the hinge members return to their quiescent states, breaking the electrical contact.

It has been found that a prototype keyswitch device according to the invention is responsive, to an advantageously even degree, to the user's fingertip pressure, regardless of upon what part of the key the fingertip pressure is concentrated.

DESCRIPTION OF THE PREFERRED EMBODIMENT

In general, a keyswitch according to the invention includes at least two hinge members. At least one of the hinge members supports a key face affixed to its key face section. When the key face is pressed, the hinge members pivot about the first and second axes to make electrical contact between electrical contact members.

The hinge member is pivotable about first and second horizontal axes intersecting the hinge member. The hinge member is made of a thin material, preferably a mylar sheet. The hinge member, for the most part, has a first resiliency.

The hinge member includes a base section and an intermediate section which interface at a first living hinge along the first axis. The hinge member further includes a key section which interfaces with the intermediate section at a second living hinge along the second axis.

In accordance with the invention, the first and second living hinges have a second resiliency which is greater than the first resiliency. That is, when the keyswitch is depressed, the hinge member flexes at its high-resiliency living hinges, while remaining substantially unflexed at the base, intermediate, and key sections. Because the intermediate section is not flexed, it is able to act as a torsion bar to restrain the key face from twisting when pressed.

The discussion which follows will present several specific embodiments of the invention, in which various techniques are used for bringing about the relatively high resiliency of the living hinges, in accordance with the invention. Therefore, the invention includes both the keyswitch product having the structural characteristics just described, and the manufacturing process used to make the keywsitch, and particularly to make the hinge member described.

Note that, for the purpose of the discussion which follows, the term "resiliency" is broadly construed as an antonym of "rigidity," to include any variant idea such as flexibility, etc. The material should be such that it will not wear out, crack, etc., in a reasonable lifetime, "reasonable" being measured in terms of a number of flexes likely to be encountered in the useful lifetime of a product, such as a computer, employing keyswitches according to the invention. It is preferable, but not essential, that the highly resilient material have a "memory," in that after a flexing force is removed, the material reverts back to its shape prior to the exertion of the flexing force.

Figure 7:
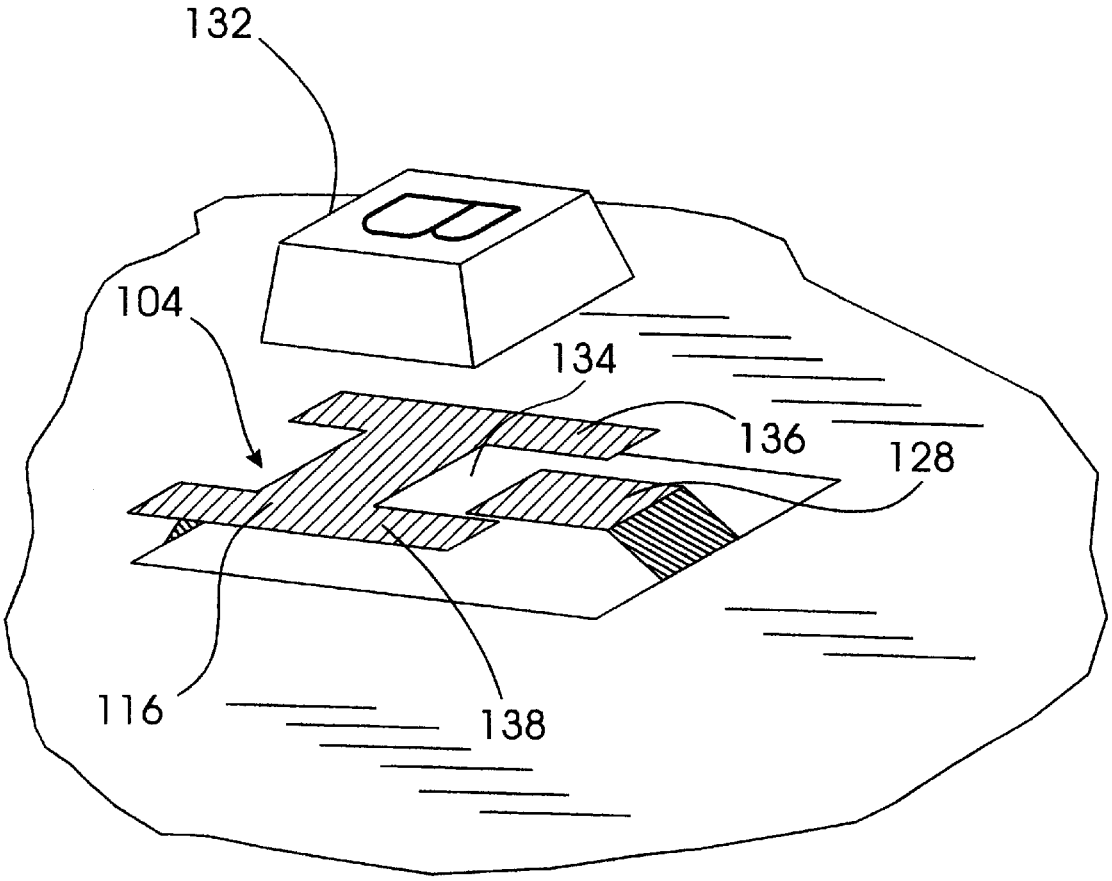
FIG. 7 is an exploded view of a key and the embodiment of FIG. 6.

Preferred Embodiment—FIG. 7

Referring to FIG. 7, there is shown a perspective view of a preferred embodiment of the thin material of the thin keyboard keyswitch assembly of the invention.

A sheet 102 of thin material, such as Mylar, is provided. For simplicity and easy visibility, a single, isolated keyswitch 104 is shown. It will be understood, however, that the invention will generally be embodied in a computer keyboard, or other comparable device, in which an array of such keyswitches (such as a QWERTY array) is provided.

To produce the keyswitch, a cutout, generally shown as 106, is made within the sheet 102. The shape of the cutout is not essential to the invention, but typically will be rectangular, to accommodate relatively dense packing of keyswitches for an array such as a keyboard.

A first hinge element 108 is produced by the cutout. The first hinge element 108 includes a base section 110, which is directly contiguous with the remainder of the sheet 102, an intermediate section 112 which interfaces with the base section 110 at a first living hinge 114 disposed along a first axis, and a key face section 116 which interfaces with the intermediate section 112 at a second living hinge 118 disposed along a second axis.

Figure 1:
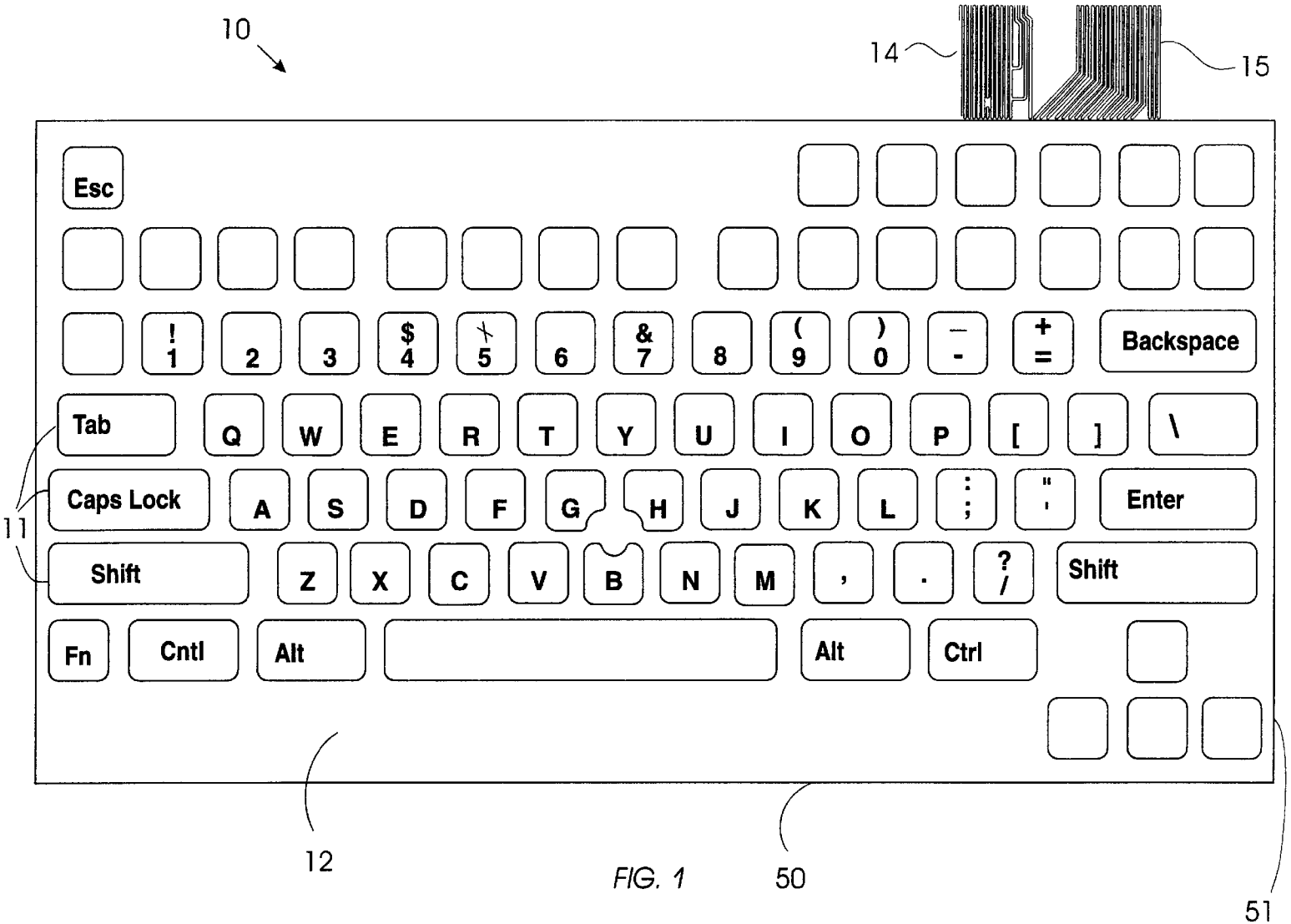
FIG. 1 is a perspective view of a keyboard assembly with which the present invention is to be used.
Figure 2:
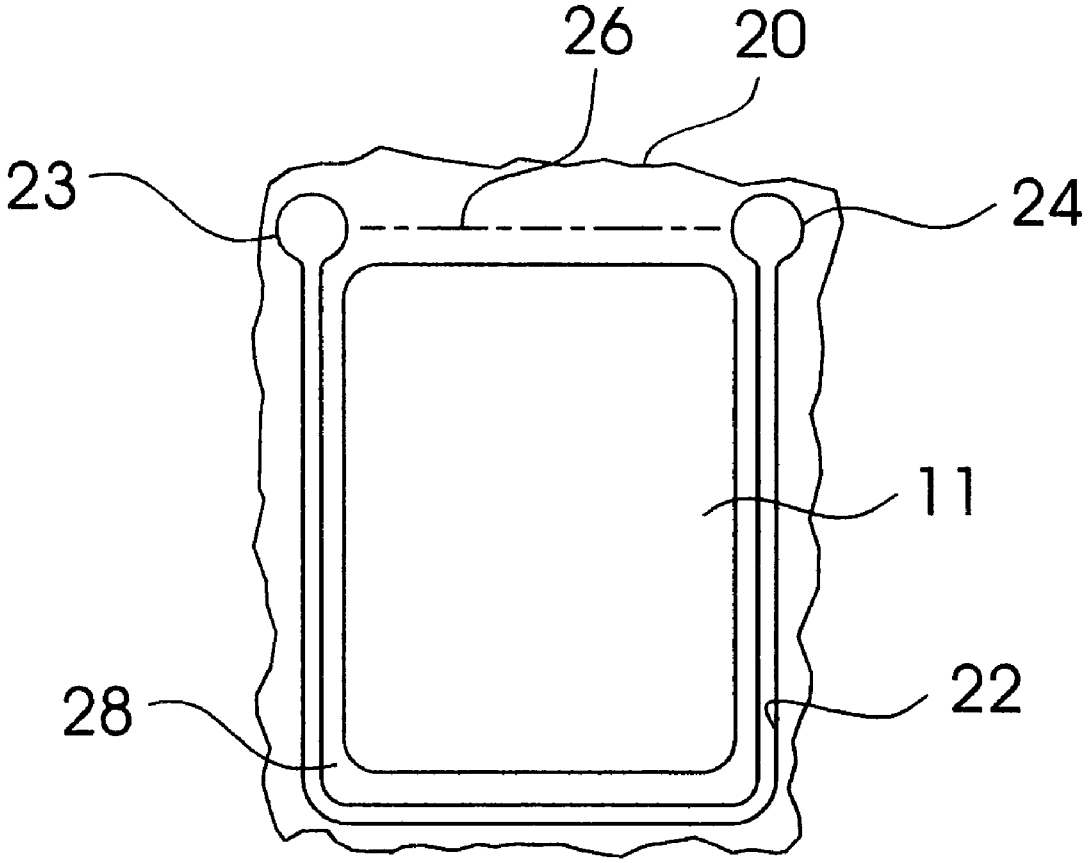
FIG. 2 (PRIOR ART)
FIG. 2 is a top view of a planar sheet for one key of a first prior art keyboard assembly.
Figure 3:
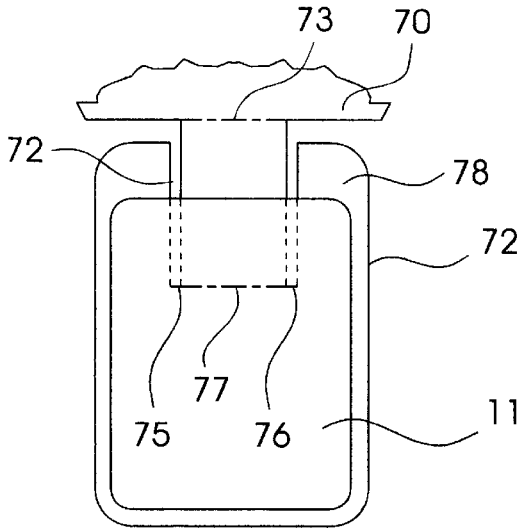
FIG. 3 (PRIOR ART)
FIG. 3 is a top view of a planar sheet for one key of a second prior art keyboard assembly.
Figure 4:
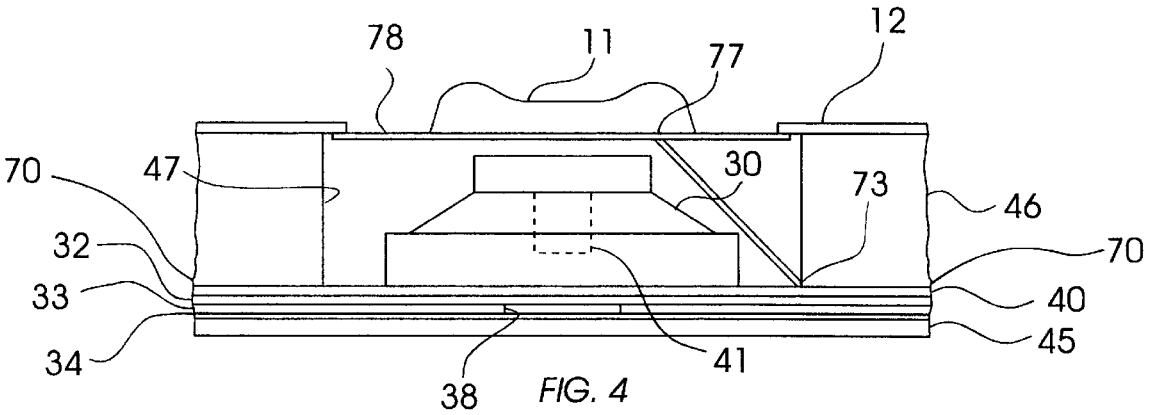
FIG. 4 (PRIOR ART)
FIG. 4 is a front elevational view of the prior art keyswitch assembly of FIG. 3, partly in section.
Figure 5:
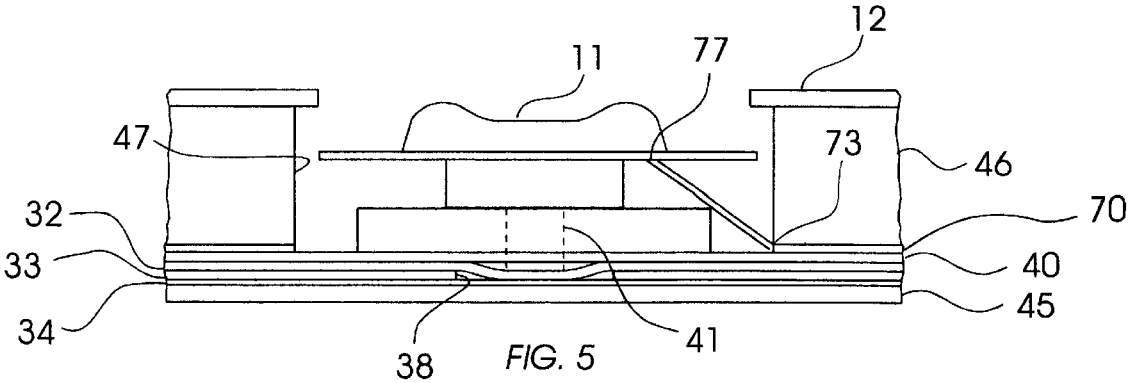
FIG. 5 (PRIOR ART)
FIG. 5 is a side elevational view of the keyswitch assembly of FIG. 3, partly in section.
Figure 6:
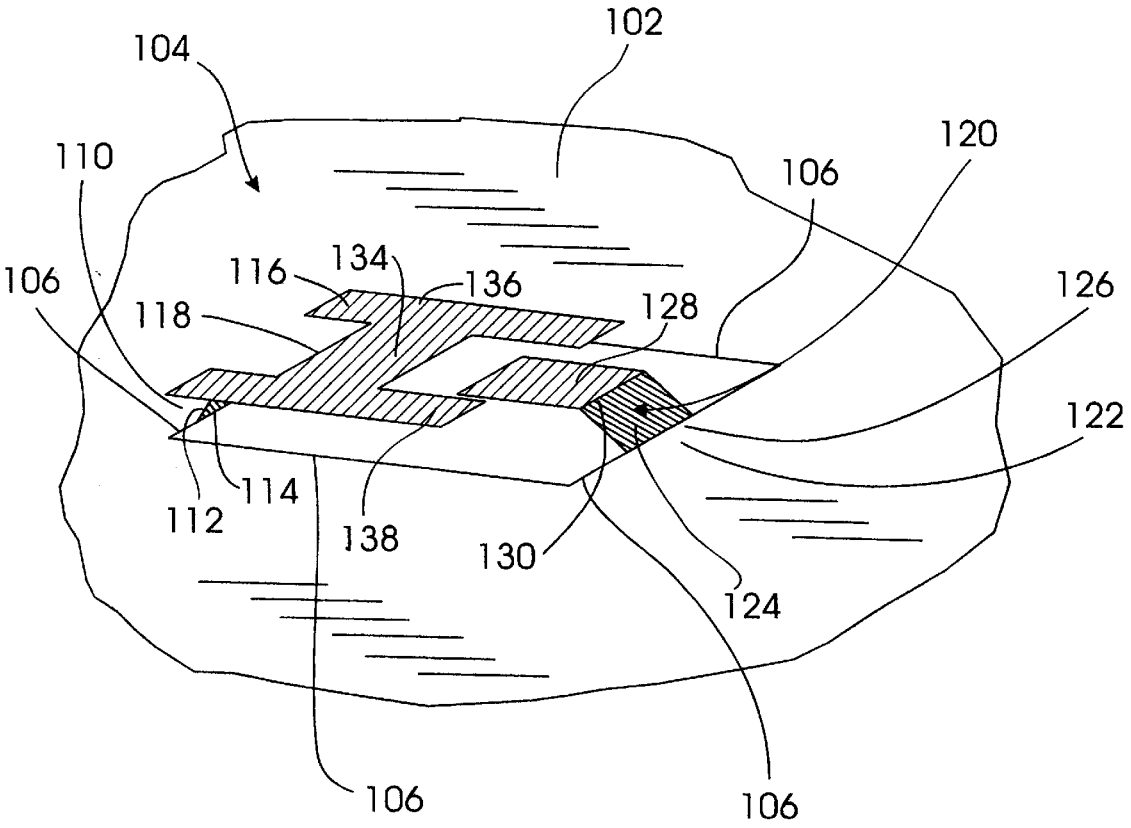
FIG. 6 is a perspective view of a preferred embodiment of the invention in a quiescent state.

Note that the base section 110 is on a first side of the cutout 106, shown in FIG. 6 as the left side of the cutout 106.

In accordance with the invention, a second hinge element 120 is also produced by the cutout. The second hinge element 120 includes a base section 122, which is directly contiguous with the remainder of the sheet 102, an intermediate section 124 which interfaces with the base section 122 at a first living hinge 126 disposed along a first axis, and a key face section 128 which interfaces with the intermediate section 124 at a second living hinge 130 disposed along a second axis.

Note that the base section 122 is on a second side of the cutout 106, shown in FIG. 6 as the right side of the cutout 106. In accordance with the invention, the base sections 110 and 122 of the two hinge elements 108 and 120 are on different sides of the cutout 106. Preferably, they are on opposite sides, as shown. It is expected, in most keyboard implementations wherein a user, facing the keyboard, perceives top and bottom sides of the keys, that the hinge elements are attached to the thin sheet 102 at the top and bottom sides.

The hinge elements 108 and 120 are shown in quiescent positions, in which they are flexed at the hinge elements to raise the key face sections 116 and 128 above the plane of the thin sheet 102. This configuration corresponds with the situation in which the key is not being pressed. It will be understood that, in this configuration, the bent arrangement of the hinges causes the key face sections 116 and 128 to be drawn apart from each other.

Note finally, that a preferred embodiment of the shapes of the key face elements 116 and 128 are shown, in which the key face section 128 nests within a notch 134 of the key face element 116, between sides 136 and 138 of the key face section 116.

Figure 8:
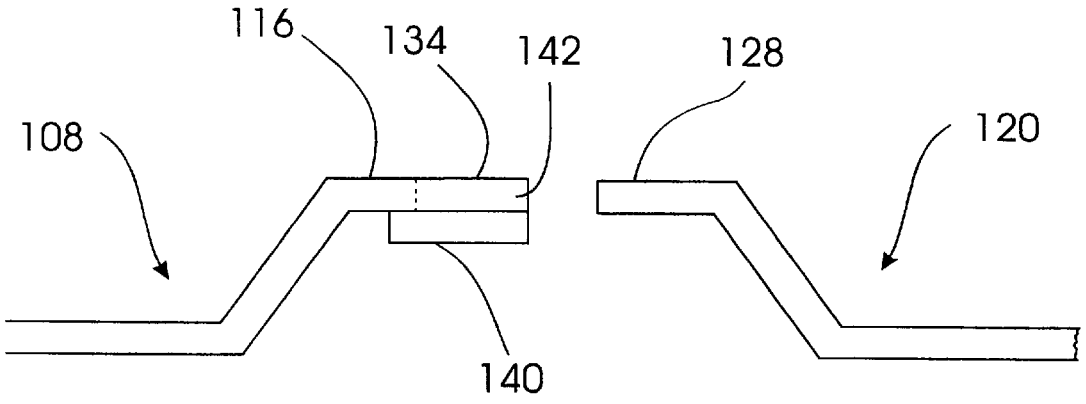
FIG. 8 is a top view showing further details of the preferred embodiment of FIG. 6.
Figure 9:
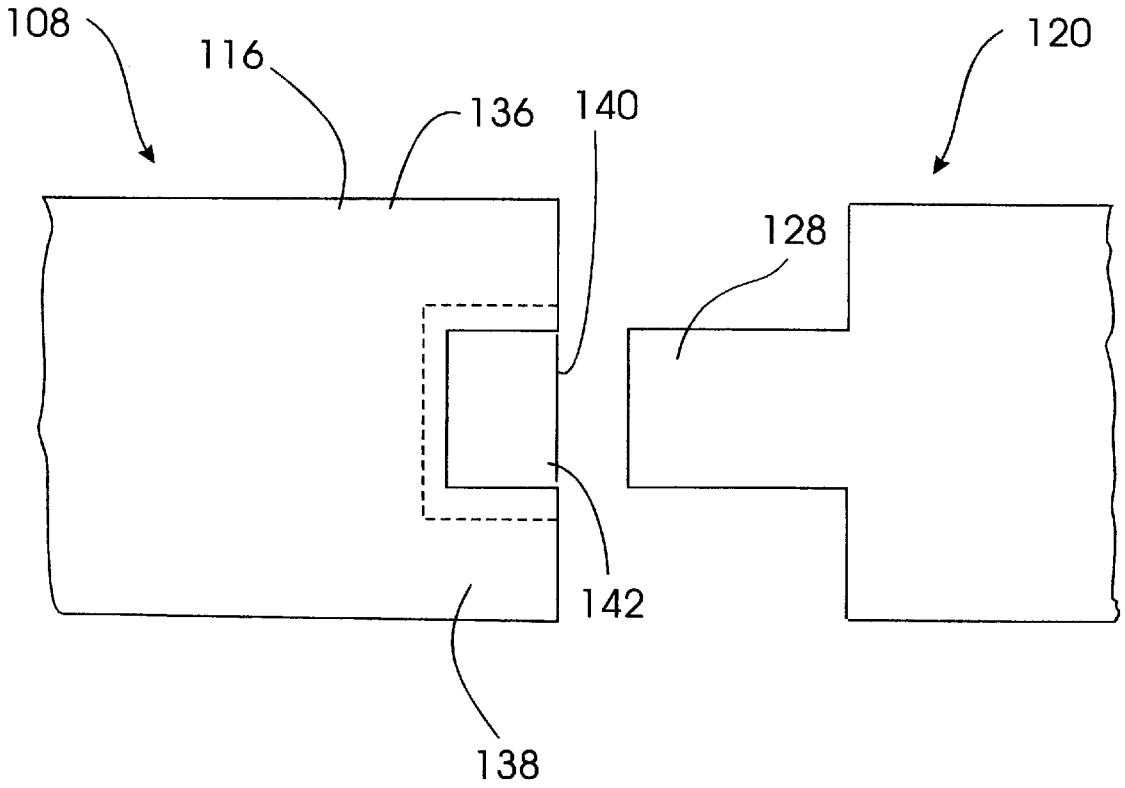
FIG. 9 is a side view showing further details of the preferred embodiment of FIG. 6.

FIGS. 8 and 9 illustrate a further preferred aspect of the notch/nesting embodiment of the invention. To cause the key face section 128 to fit inside the notch 134, and to limit the key face section 128's freedom to move below the plane of the key face section 116, an additional flat member 140 is provided immediately beneath the key face section 116. Thus, the member 140 and the sides 136 and 138 form a pocket 142, for holding the key face member 128 securely.

FIG. 7 is a perspective, exploded view of the keyswitch 104 of FIG. 6, omitting most of the reference numbers for clarity, and further including a key 132, which is disposed above the key face sections 116 and 128 of the first and second hinge elements 108 and 120. Electrical contact elements (not shown) are disposed beneath the keyswitch 104.

In operation, when the user depresses the key 132, the hinge elements 108 and 120 are flexed, at the hinges 114,118,126, and 130, causing the hinge elements 108 and 120 to flatten. The flattening of the hinge elements 108 and 120 causes the electrical contact elements to make contact, essentially in conventional fashion, to produce a keystroke signal which is then processed by a computer device, or the like, as user input.

In accordance with the invention, the two hinge elements provide support and stability for the key, resulting in a keystroke which gives the user visual and tactile satisfaction. In particular, the distribution of the two hinge elements causes a balancing between the responsiveness and the pressure requirements of the sides of the key.

In a preferred embodiment of the invention, as shown in FIGS. 6 and 7, the second hinge element 120 is relatively narrow, and nests inside the notch 134, between the sides 136 and 138. This arrangement is considered to be advantageous because it provides better-distributed support for the key, while being easily cut from the thin sheet 102. Alternative embodiments could simply have the two hinge elements identical in shape, shorter in length, and abutting each other at their ends.

It is considered to be preferred if the two hinge elements are on opposite sides of the keyswitch cutout 104, as shown in FIGS. 6 and 7. However, depending on factors such as the overall distribution of keyswitches, the particular geometry of the keyswitch, the angle from which the user is likely to approach the keyboard, and numerous other factors that would be understood, encountered, or foreseen by persons skilled in the art of keyboard design and fabrication, a wide variety of other hinge element configurations may be used. For instance, in a generally rectangular keyswitch geometry, the two hinge elements could be ninety degrees apart, and could have a suitable shape to accommodate their proximity.

Also, the number of hinge elements per keyswitch could vary. For instance, where a generally hexagonal keyswitch geometry is used, three hinge elements, for instance 120 degrees apart, and having suitable shapes, may be used.

While the preferred embodiments of the present invention have been illustrated in detail, it should be apparent that modifications and adaptations to those embodiments may occur to one skilled in the art without departing from the scope of the present invention as set forth in the following claims.

What is claimed is:

1. A keyswitch assembly comprising:

electrical contact members having normally separated contacts, which make electrical contact when the keyswitch assembly is vertically compressed; and a thin sheet of resilient material having first and second cutout hinge members, the hinge members supporting a key face, each hinge member being pivotable about respective first and second horizontal axes intersecting the respective hinge member, each hinge member including a respective base section and a respective intermediate section which interfaces at a respective first living hinge along the respective first axis, each hinge member further including a respective key section which interfaces with the respective intermediate section at a respective second living hinge along the respective second axis;

whereby, when the key face is pressed, each hinge member pivots about its respective first and second axes to make electrical contact between the electrical contact members, and the first and second hinge members act to balance key motion and stabilize key pressure and a tactile feel of the key.

2. A keyswitch assembly as recited in claim 1, wherein:

the keyswitch cutout is in accordance with a keyswitch geometry having a plurality of sides including sides opposite to each other; and the first and second hinge members are disposed on the opposite sides of the keyswitch geometry.

3. A keyswitch assembly as recited in claim 1, wherein:

the key section of the first hinge member includes a notch and two sides about the notch; and the key section of the second hinge member nests within the notch of the first hinge member.

4. A keyswitch assembly as recited in claim 3, further comprising a member disposed on the key section of the hinge member, adjacent to the notch, whereby the member and the two sides define a pocket for holding the key section of the second hinge member.

5. A keyboard face member, for use with a keyboard having a keyswitch assembly including electrical contact members having normally separated contacts, which make electrical contact when the keyswitch assembly is vertically compressed, the keyboard face member comprising:

a planar sheet having first and second cutout hinge members, the hinge members supporting a key face, each hinge member being pivotable about respective first and second horizontal axes intersecting the respective hinge member, each hinge member including a respective base section and a respective intermediate section which interfaces at a respective first living hinge along the respective first axis, each hinge member further including a respective key section which interfaces with the respective intermediate section at a respective second living hinge along the respective second axis;

whereby, when the key face is pressed, each hinge member pivots about the respective first and second axes to make electrical contact between the electrical contact members, and the first and second hinge members act to balance key motion and stabilize key pressure and a tactile feel of the key.

6. A keyboard face member as recited in claim 5, wherein:

the keyswitch cutout is in accordance with a keyswitch geometry having a plurality of sides including sides opposite to each other; and the first and second hinge members are disposed on the opposite sides of the keyswitch geometry.

7. A keyboard face member as recited in claim 5, wherein:

the key section of the first hinge member includes a notch and two sides about the notch; and the key section of the second hinge member nests within the notch of the first hinge member.

8. A keyboard face member as recited in claim 7, further comprising a member disposed on the key section of the hinge member, adjacent to the notch, whereby the member and the two sides define a pocket for holding the key section of the second hinge member.

9. A keyboard assembly comprising:

a key face;

a plurality of electrical contact members having normally separated contacts which make electrical contact when the key face vertically compressed; and a planar sheet having first and second cutout hinge members, the hinge members supporting the key face, each hinge member being pivotable about respective first and second horizontal axes intersecting the respective hinge member, each hinge member including a respective base section and a respective intermediate section which interfaces at a respective first living hinge along the respective first axis, each hinge member further including a respective key section which interfaces with the respective intermediate section at a respective second living hinge along the respective second axis;

whereby, when the key face is pressed, each hinge member pivots about the respective first and second axes to make electrical contact between the electrical contact members, and the first and second hinge members act to balance key motion and stabilize key pressure and a tactile feel of the key.

10. A keyboard assembly as recited in claim 9, wherein:

the keyswitch cutout is in accordance with a keyswitch geometry having a plurality of sides including sides opposite to each other; and the first and second hinge members are disposed on the opposite sides of the keyswitch geometry.

11. A keyboard assembly as recited in claim 9, wherein:

the key section of the first hinge member includes a notch and two sides about the notch; and the key section of the second hinge member nests within the notch of the first hinge member.

12. A keyboard assembly as recited in claim 11, further comprising a member disposed on the key section of the hinge member, adjacent to the notch, whereby the member and the two sides define a pocket for holding the key section of the second hinge member.

* * * * *